United States Patent [19]

Joshi

[11] Patent Number: 5,053,159

[45] Date of Patent: Oct. 1, 1991

[54] LAUNDRY DETERGENT BAR

[75] Inventor: David Joshi, South Plainfield, N.J.

[73] Assignee: Colgate-Palmolive Company, Piscataway, N.J.

[21] Appl. No.: 433,263

[22] Filed: Nov. 8, 1989

[51] Int. Cl.[5] ..... C11D 3/48; C11D 3/065

[52] U.S. Cl. ..... 252/106; 252/DIG. 16; 252/533; 252/534; 252/531

[58] Field of Search ..... 252/106, DIG. 16, 531, 252/533, 534

[56] References Cited

U.S. PATENT DOCUMENTS

| | | | |
|---|---|---|---|
| 3,433,578 | 10/1963 | Reid | 252/106 |
| 3,824,190 | 7/1974 | Winicov | 252/106 |
| 3,846,326 | 11/1974 | Wright et al. | 252/107 |
| 4,021,574 | 5/1977 | Bollag et al. | 424/324 |
| 4,322,308 | 3/1982 | Hooper et al. | 252/107 |
| 4,543,204 | 9/1985 | Gervasio | 252/531 |
| 4,806,273 | 2/1989 | Barone et al. | 252/544 |

FOREIGN PATENT DOCUMENTS 566139 12/1944 United Kingdom .

OTHER PUBLICATIONS

Hawleys Condensed Chemical Dictionary 11th Edition, Edited by N. Irving Sax, van Nostrand, Reinhold, N.Y., pp. 53, 489, 490.

*Primary Examiner*—Prince E. Willis
*Assistant Examiner*—J. Silbermann
*Attorney, Agent, or Firm*—Robert Sullivan; Murray Grill; Richard J. Ancel

[57] ABSTRACT

An antibacterial detergent laundry bar based on alkyl benzene sulfonate which has good foamability and skin mildness is disclosed. The formulation consists of about 10 to 35 percent alkyl benzene sulfonate, about 10 to 35 percent higher fatty alcohol sulfate, about 1 to 10 percent cocoamido propylamine oxide, about 0.2 to 2 percent phenoxy ethanol antibacterial agent and about 5 to 20 percent water.

2 Claims, No Drawings

LAUNDRY DETERGENT BAR

FIELD OF THE INVENTION

The invention relates to an antibacterial detergent bar based on alkyl benzene sulfonate which has good foamability and skin mildness, good bar texture, physical hardness and the ability to sanitize clothes and remove germs for an antiseptic wash.

SUMMARY OF THE INVENTION

It is the object of this invention to provide an antibacterial synthetic detergent bar having good foamability, skin mildness and physical hardness which, when used, will sanitize the clothes and remove germs for an antiseptic wash.

Another object of this invention is to provide a manufacturing procedure which produces an antibacterial synthetic laundry bar which has good foamability and skin mildness.

BACKGROUND OF THE INVENTION

Soap bars have long been employed for washing the human body and for "doing laundry". Before the advent of washing machines dictated the employment of detersive materials in powder, disintegrable briquette or liquid forms, laundry was washed with "laundry soap" bars made from suitable soaps of higher fatty acids, such as sodium soaps of mixed tallow and rosin fatty acids. Such laundry soap bars were especially suitable for being rubbed onto badly stained or soiled portions of fabrics being laundered, as on a washboard, to deposit a high concentration of the soap on the soiled area, and they provided mechanical means for applying energy to such surfaces to assist in removing the stains and soils.

Despite the fact that after the introduction of synthetic organic detergents and washing machines the amount of soap employed for laundry use diminished greatly, soap in bar or cake form is still the personal cleaning agent of choice in most of the world, and laundry soaps and detergents in bar form are also still preferred by many consumers in various regions. Detergent laundry bars based on alkylbenzene sulfonate detergents have been successfully marketed. They have been characterized as the equivalents in washing abilities of powdered laundry detergents based on similar alkylbenzene sulfonates, and are considered by many consumers to be more convenient to use. To use them does not require the purchase of a washing machine and, as was previously indicated, the bar form of the product allows it to be used in such manner that a comparatively high concentration of detersive material may be readily applied to a heavily stained or soiled area with accompanying physical force or energy, as on a washboard, so as more readily to loosen and remove such soil or stain.

Efforts to incorporate antibacterial agents into laundry products have been well known. They are to sanitize the clothes and remove germs for an antiseptic wash. Many bactericides, such as trichloro carbanilide, diphenyl ethers etc. have been tried. The use of these compositions has not been satisfactory because of their high cost when used at useful levels. In addition the compounds frequently break down at high pH or under high temperature processing conditions. In addition high levels of fragrances have to be used to maintain an adequate scent to the final product.

BRIEF DESCRIPTION OF THE INVENTION

It has now been found that an effective antigerm agent, phenoxy ethanol, is effective against major bacteria species and is quite safe and stable. This compound is quite inexpensive and in addition has a pleasant fragrance of its own and thus decreases or eliminates the need for the addition of perfumes to the formulation. The compound has a pleasant fragrance of its own and is substantive on the clothes to provide a long lasting protection against germs and bad odor.

A search for the prior art has resulted in the finding of various patents which, while they refer to bactericides in general, do not make the present invention obvious to one skilled in the art. The most relevant of these references is British patent 566,139 which describes ethers of ethylene glycol in which one of the hydroxyl groups is etherified by an aromatic group. The reference discloses the compounds may have bactericidal properties.

U.S. Pat. No. 3,824,190 to Winicov describes the use of diol esters and diol ethers as bactericides. U.S. Pat. No. 3,824,190 gives a general review of patents on phenols as disinfectants.

U.S. Pat. No. 4,322,308 to Hooper et al states that germicides have limited effectiveness as a sole deodorant agent in soap bars in combatting the problems of body malodour.

None of these references anticipate or makes obvious the subject matter of the present invention, providing a soap bar that when used, provides long lasting protection against germs and bad odor.

DETAILED DESCRIPTION OF THE INVENTION

As pointed out above the essential feature of the invention is the inclusion of from 0.2 to 2% of a phenoxy ethanol antibacterial agent in a laundry detergent bar having good foamability and skin mildness characteristics.

The higher fatty alcohol sulfate is one in which the fatty alcohol is normally in the range of 10 to 18 carbon atoms. The cations will almost invariably be sodium although other cation, such as potassium, ammonium, magnesium and calcium may be present, usually in minor amounts with a sodium detergent normally constituting more than 50%, preferably more than 75% and most preferably substantially all the fatty alcohol sulfate content of a laundry bar.

The fatty alcohol sulfate is preferably derived from coconut oil although palm and/or palm kernel oils may also be used.

The combination also preferably contains approximately an equal amount of an alkylene benzene sulfonate. The alkyl moiety of the sulfonate can be in a range of 10 to 18 carbon atoms. The cation will almost invariable be sodium although potassium, ammonium, magnesium and calcium may also be present, normally in minor amounts.

Various water-soluble builder salts usually sodium salts may be incorporated into laundry bars. One of the most important being the phosphates particularly the poly phosphates, such as sodium tripolyphosphate and sodium pyrophosphate. Other builder salts of the chelating or precipitating type may also be used. The inorganic salts are preferred the preferred salts are sodium carbonate and sodium silicate. The $Na_2O$ to $SiO_2$ ratio and the sodium silicate can be approximately 1.1 to 1.6 to 1 to 3 preferably 1 to 2 to 1 to 3. In addition to the watersoluble builder insoluble materials can also be used, such as detergent building calcium ion exchange zeolites including the hydrated zeolites. Zeolite A is preferred.

Water-insoluble particulate material components of being present bar hereinafter referred to as bodying agents contributes significantly to the formulation of a firm processable laundry bar and help to regulate the release of a detergent from the bar when in use. While many insoluble material may be employed, such as clays, talc, calcium silicate, magnesium silicate, calcium sulfate, silica, calcium phosphate and calcium carbonate, the most often used material is calcium carbonate often obtained from calcite. The calcium carbonate and other insolubles will normally be in finely divided form and often substantially all passed through a number two seive.

The formulation also contains 1 to 10% preferably 3 to 5% cocoamido propylamine oxide. The addition of this component to the formulation has been found to impart foamability, processability and skin mildness of the laundry bar.

Various adjuvants may be employed in the present detergent bars for their individual desirable effects. Among these adjuvants are dyes, such as red or blue dyes and aquamarine blue pigment and whitening agents, such as titanium oxide. Perfumes and brighteners can also be present.

The essential feature of the invention is pointed out above as is the addition of from 0.2 to 2% phenoxy ethanol antibacterial agent. This agent is particularly desirable since it has a pleasant odor and thus decreases or eliminates the need for the addition of perfume to the soap formulation.

In addition to the other components water will be present in a laundry bar while it is preferred to employ deionized water, tap water or city water may be used. The water serves as a mutual solvent and plasticizing agent for various components of the detergent bar and facilitates the hydration of some of the hydratable materials, such as sodium polyphosphate, sodium pyrophosphate, sodium carbonate, sodium sulfate, etc.

The final bar will have a total content of coco alcohol sulfate and sodium alkyl benzene sulfate of about 10 to 35%, preferably 15 to 30%. The formulations preferably contain approximately equal amounts of sodium alkyl benzene sulfate and sodium coco fatty acid sulfate. In the especially preferred formulation each of the components is present as 19 to 20% of the formulation. The builder will normally be in a range of 10 to 30%, preferably 15 to 20%. The water content of the formulation is normally about 5 to 22%, preferably 5 to 15% more preferably 6 to 12%. With respect to the individual builders and bodying agents it is preferable that the builders include 5 to 25% sodium tripoly phosphate, 5 to 25% sodium carbonate, and 0 to 10% sodium silicate, preferably 1 to 2%. The bodying agent, preferably a water-insoluble powder will consist of 10 to 20%, preferably 15 to 20% calcium carbonate.

The adjuvant content in the formulation will usually be limited to 5%, preferably 2%. The individual adjuvants will normally be present at 0.1 to 1% of the formulation.

The invented detergent laundry bars can be processed with available equipment of types used for manufacturing soap and detergent bar products. Initially, a heavy duty amalgamator or mixer, such as one equipped with sigma-type blades or one equipped with counter-rotating paddle type agitators, is used to mix the various components, most of which are powdered but some of which may be in liquid state, sometimes as aqueous solutions. The order of addition of the various components of the laundry bars is not considered to be important as long as reasonable care is taken to prevent complete or premature hydration of the phosphate (and any other hydratable components which desirably hydrate during working of the composition), and to prevent any excessive lumping or concretion which could occur in the mixing process.

The mixing may take only a short time, but can take from one minute to an hour, with the usual mixing time being from 2 to 15 minutes.

The mixed product will desirably be in separable solid form at about room temperature and will be charged, preferably by means of a multi-worm transfer conveyor (preferably equipped with cooling means), to a multi-rolled mill, such as a five-roll Lehmann mill of the soap mill type. The mill will be equipped with means for heating or cooling and normally the cooling means will be employed to maintain the ribbon temperature from the mill within the range of about 30° to 40° or 45° C.

Various ribbon and chip thicknesses may be employed but usually such thicknesses will be in the range of 0.1 to 1 mm, preferably 0.2 to 0.4 or 0.5 mm. However, other thicknesses may be made, depending on particular formulations being milled, so long as the composition is satisfactorily homogenized on the mill and providing that any coarse particles that may be present are pulverized so that the finished product is not objectionably gritty.

The milled chips, or milled materials, in other form, are then conveyed to a double stage vacuum plodder, operating at a high vacuum, e.g. 600 to 740 millimeters of mercury vacuum in which any entrapped air is evacuated. The mass of laundry detergent composition is worked in the plodder and is extruded from it as a bar. The plodder is equipped with a heated nozzle which softens the composition immediately prior to extrusion, allowing the production of a uniform and homogeneous bar. Such bar may be cut to length and impressed with a product brand name by means of a combination of rotary cutter and imprinter, or it may be cut to lengths, called blanks, and may be stamped to shape in a press. Before pressing, the blanks may be cooled in a cooling tunnel. If not pressed, the cut lengths are cooled before wrapping. In either case the cooled bars are automatically wrapped, cased and sent to storage, prior to shipping.

The previous descriptions is one for the manufacture of the laundry detergent bars of this invention when the anionic detergents are added to the mixer in powder, flake or paste form. However, one or more of such detergents, may also be formed in situ by neutralizing the appropriate corresponding detergent acid(s) with soda ash or other suitable neutralizing agent, when that is feasible. Such a reaction may result in the production of sodium sulfate from any excess sulfuric acid present or if excess soda ash is employed sodium carbonate may result. Unreacted higher fatty alcohol may also be present with the detergent. All such materials are useful components of the present laundry bars. The described neutralization reaction may be effected in a separate reactor but may also be conducted in the mixer to be employed for mixing the other laundry bar constituents with the anionic detergents.

The laundry detergent bars made according to the invention have superior foamability, processability and mildness characteristics due to the presence of 1 to 10%, preferably 2 to 5% cocoamido propylamine oxide in the formulation.

The addition of 0.2 to 2% of the peroxy ethanol antibacterial agent results in the preparation of a laundry bar having the features set out above.

The invention is illustrated by the following specific but non-limiting examples.

EXAMPLE I

A detergent bar having the components set out in Table I below was made by a process which includes the steps of mixing, milling, plodding, cutting, to lengths impressing to shape as set out above.

TABLE I

| Bar Formulation in percent | |
|---|---|
| Sod. Alkyl Benzene Sulfonate | 19.2 |
| PVA/MaCopolymer (Gantrez An-119) 10% Solution | 0.5 |
| Magnesium Sulfate Peptahydrate | 0.8 |
| Sodium Silicate Solution (44%) | 1.25 |
| Trisodium Pyrophosphate | 2.5 |
| Sodium Aluminum Silicate (Zeolite A) | 2.5 |
| Sodium Carbonate | 7.5 |
| Coco Fatty Alcohol Sulfate Paste (7)% AI) | 14.00 |
| Cocoamido Propylamine Oxide (30% AI) | 5.0 |
| Phenoxy Ethanol | 0.5 |
| Sodium Carbonate | 7.50 |
| Calcium Carbonate | 17.5 |
| Minors (Colors, Perfume, Brightners, etc.) | 1.0 |
| Calcium Carbonate | Q.S. |
| Trisodium Pyrophosphate | 12.5 |

The bars were evaluated by expert evaluators and by consumors and found to have satisfactory utilitarian characteristics. In addition the bars have excellent antibacterial properties.

EXAMPLE II

A test to determine the efficacy of a laundry bar of the formulation set out above against E coli bacteria was performed. In this test the bacteria were subjected to 1% detergent solution. The bacterial counts after 10 minutes contact are set out in Table II below.

TABLE II

| | Bacterial Count CFU/ML | Log 10 | Log Reduction | % Reduction |
|---|---|---|---|---|
| No Phenoxy Ethanol | $2.1 \times 10^7$ | 7.32 | 0 | 0 |
| 0.2% Phenoxy Ethanol | $1.5 \times 10^5$ | 5.18 | 2.40 | >99.00 |
| 0.5% Phenoxy Ethanol | $9.3 \times 10^4$ | 4.97 | 2.61 | >99.00 |
| 1.5% Phenoxy Ethanol | $2.7 \times 10^4$ | 4.43 | 3.15 | >99.00 |
| Water Only | $3.7 \times 10^7$ | 7.57 | — | — |

As is apparent from the data that the addition of a little as 0.2% phenoxy ethanol to the detergent bar results in a greater than 99% reduction of the bacterial count. As pointed out above the phenoxy ethanol has a pleasant odor so that the addition of this compound to the detergent bar greatly reduces or eliminates the need for addition of perfume to the formulation.

Obviously many modifications and variations of the invention may be made without departing from the essence and scope thereof and only some limitation should be applied as indicated in the appended claims.

What is claimed is:

1. An antibacterial detergent laundry bar which consists of 10 to 25 percent sodium alkyl benzene sulfonate, 10 to 25 percent sodium higher fatty alcohol sulfate wherein the higher fatty alcohol is of 12 to 15 carbon atoms, 3 to 5 percent of coco amido propylamine oxide, 15 to 30 percent sodium tripolyphosphate, 5 to 25 percent sodium carbonate powder, 0.2 to 2 percent of a phenoxy ethanol antibacterial agent and 5 to 12 percent water.

2. A milled and plodded antibacterial detergent bar according to claim 1 consisting of about 19 percent sodium alkyl benzene sulfonate, about 19 percent sodium coco alcohol sulfate, about 5 percent cocoamido propylamine oxide, about 15 percent sodium carbonate, about 17 percent calcium carbonate powder, about 0.5 percent phenoxy ethanol antibacterial agent and about 9 percent water.

* * * * *